US008824118B2

(12) United States Patent
Gielniewski et al.

(10) Patent No.: US 8,824,118 B2
(45) Date of Patent: Sep. 2, 2014

(54) METHOD OF REMOVAL OF ELECTROSTATIC CHARGES FROM TRAYS USED FOR TRANSPORTING ROD SHAPED ELEMENTS, TRAY PROTECTED AGAINST NEGATIVE ACTION OF ELECTROSTATIC FIELD AND DEVICE FOR UNLOADING TRAYS FILLED WITH ROD SHAPED ELEMENTS WITH SIMULTANEOUS REMOVAL OF ELECTROSTATIC CHARGES

(75) Inventors: Adam Gielniewski, Radom (PL); Radoslaw Owczarek, Radom (PL)

(73) Assignee: International Tobacco Machinery Poland SP. ZO.O, Radom (PL)

( * ) Notice: Subject to any disclaimer, the term of this patent is extended or adjusted under 35 U.S.C. 154(b) by 118 days.

(21) Appl. No.: 13/574,089

(22) PCT Filed: Jan. 19, 2011

(86) PCT No.: PCT/PL2011/000007

§ 371 (c)(1),
(2), (4) Date: Jul. 19, 2012

(87) PCT Pub. No.: WO2011/090395

PCT Pub. Date: Jul. 28, 2011

(65) Prior Publication Data

US 2012/0293906 A1 Nov. 22, 2012

(30) Foreign Application Priority Data

Jan. 21, 2010 (PL) ..... 390247

(51) Int. Cl.
*H02H 1/04* (2006.01)
*A24C 5/356* (2006.01)
*A24C 5/358* (2006.01)

(52) U.S. Cl.
CPC ..... *A24C 5/356* (2013.01); *A24C 5/358* (2013.01)
USPC ..... 361/220; 361/212

(58) Field of Classification Search
USPC ..... 361/212, 220
See application file for complete search history.

(56) References Cited

U.S. PATENT DOCUMENTS 3,757,164 A * 9/1973 Binkowski ..... 361/212
5,270,901 A * 12/1993 Nowak et al. ..... 361/212

(Continued)

FOREIGN PATENT DOCUMENTS

EP 1 108 368 A2 6/2001
EP 1 661 634 A2 5/2006

(Continued)

OTHER PUBLICATIONS

International Search Report of PCT/PL2011/000007, mailing date Jul. 22, 2011.

(Continued)

*Primary Examiner* — Danny Nguyen
(74) *Attorney, Agent, or Firm* — Westerman, Hattori, Daniels & Adrian, LLP

(57) ABSTRACT

A method of removing electrostatic charges from a tray by supplying pressurized ionized air, first along the bottom of the already turned over tray, and then, when unloading the tray, along its side walls or the inner walls of a compartment. A tray made of dielectric material and protected against negative action of the electrostatic field and having a conducting metal insert provided on the inside of the tray. The insert may have different shapes. A device for unloading compartment trays made of a dielectric material and provided with an ionizer disposed horizontally along the linear transporter, in the zone of feeding of the trays with its nozzles turned in the direction of the inside of the bottom of the tray.

20 Claims, 6 Drawing Sheets

(56) References Cited

U.S. PATENT DOCUMENTS

Figure 1:
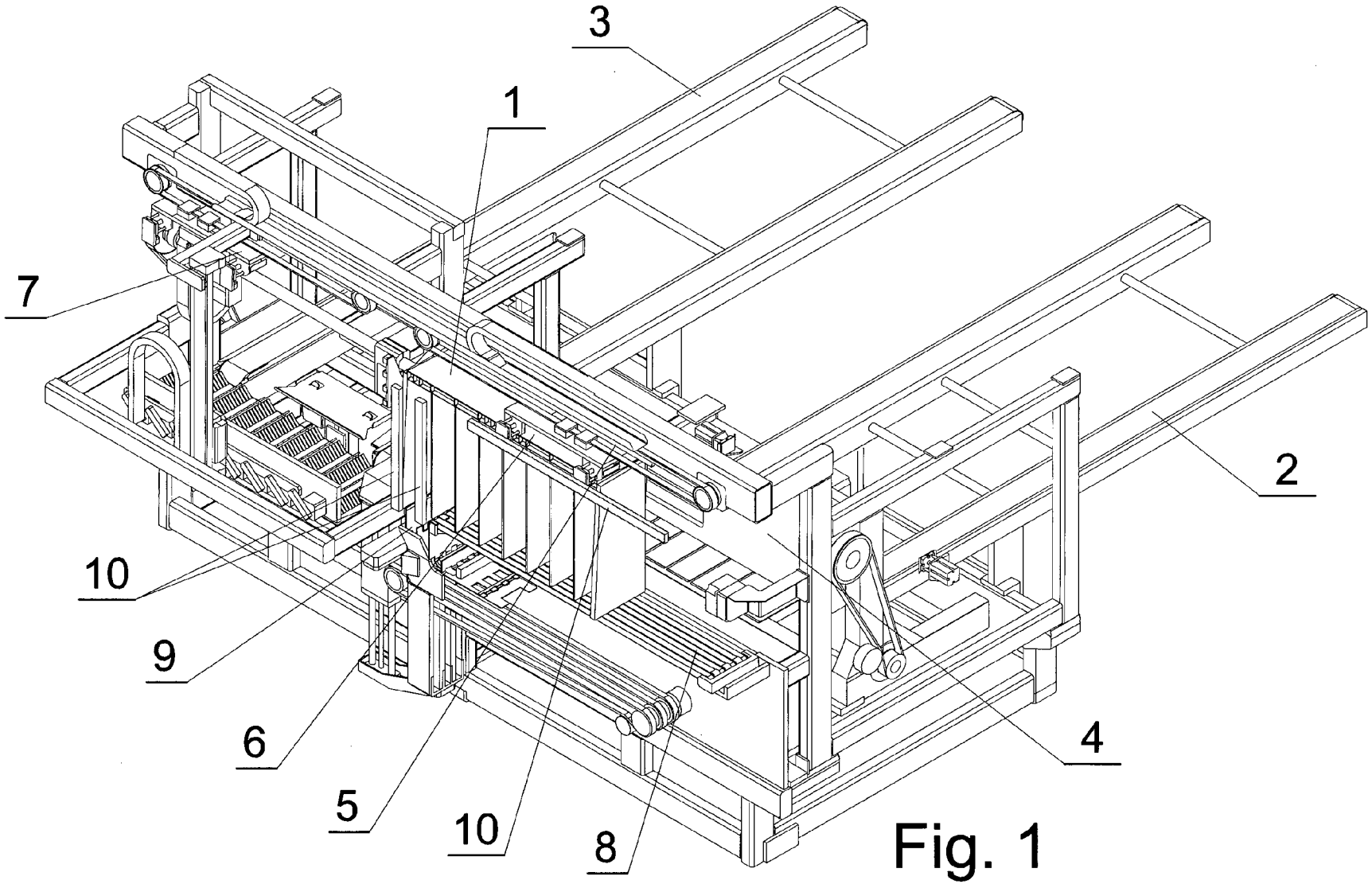

| | | | |
|---|---|---|---|
| 2001/0003391 | A1 | 6/2001 | Heitmann |
| 2006/0107968 | A1 | 5/2006 | Schmidt et al. |
| 2008/0223803 | A1 | 9/2008 | Budny et al. |
| 2011/0056801 | A1 | 3/2011 | Sikora et al. |
| 2011/0058924 | A1 | 3/2011 | Sikora et al. |

FOREIGN PATENT DOCUMENTS

| | | | |
|---|---|---|---|
| EP | 1 972 212 | A1 | 9/2008 |
| WO | 2009/145651 | A1 | 12/2009 |

OTHER PUBLICATIONS

Written Opinion of PCT/PL2011/000007, mailing date Jul. 22, 2011.

* cited by examiner

METHOD OF REMOVAL OF ELECTROSTATIC CHARGES FROM TRAYS USED FOR TRANSPORTING ROD SHAPED ELEMENTS, TRAY PROTECTED AGAINST NEGATIVE ACTION OF ELECTROSTATIC FIELD AND DEVICE FOR UNLOADING TRAYS FILLED WITH ROD SHAPED ELEMENTS WITH SIMULTANEOUS REMOVAL OF ELECTROSTATIC CHARGES

Subject matter of the invention is a method of removing electrostatic charges from trays used for transporting rod shaped elements in tobacco industry as well as a tray protected against negative action of electrostatic field during unloading of rod shaped elements and a device for unloading trays, particularly those protected against negative action of the electrostatic field with simultaneous removal of electrostatic charges occurring in the tray and in the rod shaped elements.

The trays are used in production lines manufacturing tobacco products, such as cigarettes, filters, cigars or cigarillos, as intermediate stores used for temporary storage of rod shaped elements and/or transporting them from the making machine for further operations. Since many years, the trays have been manufactured using the method of injection of plastic resistant to the action of components occurring in the tobacco or the filters. All trays have the shape of a cuboid case, usually without the front wall and the top wall, with movable or immovable bottom wall, whereas the width of the bottom wall corresponding with the depth of the tray is dependent on the length of rod shaped elements. Such tray with the movable bottom wall was presented in the description of the German utility model No. DE 1.882.950, and a tray with the immovable bottom wall was presented in the description of the German utility model No. DE 1.865.075. In order to stabilize the mass of rod shaped elements, particularly during loading and unloading, trays which are divided inside into a certain number of compartments with the aid of vertical inner walls parallel to the side walls of the tray are used as well. Such a tray, constituting an intermediate store, is disclosed in the description of the German utility model No. DE 1.915.446. One of the devices for mechanical unloading of compartment trays was presented in the international publication of the patent No. WO 2009/145651 owned by the applicant of this invention. The device for unloading trays which was presented there, with the trade name MFM TU, has an inlet conveyor for full trays and an outlet conveyor for empty trays arranged parallel in one plane, and a turning unit for full trays situated in the end zone of the inlet conveyor, provided with a plate supporting rod shaped elements in a tray, and has an unloading conveyor and a conveyor for out-feeding a stack of rod shaped elements unloaded into the throat. Moreover, the unloading device is provided with a linear transporter for full and empty trays, situated in a plane perpendicular to the plane of an inlet conveyor and outlet conveyor, above the turning unit for full trays and the turning unit for empty trays. The linear transporter is provided with a gripping unit, arranged movably, for full trays, and a gripping unit for empty trays. Said unloading conveyor for rod shaped elements is situated below the linear transporter in the zone of operating of the gripping unit for full trays so that its end is situated at the inlet of the immovable throat, whereas the distance between the gripping unit for full trays and the unloading conveyor corresponds to the height of the tray. The turning unit for full trays is provided with a plate for supporting rod shaped elements, fixed to a main plate of the turning unit, consisting of plurality of elements the number of which corresponds to the number of compartments of a compartment tray, and the distance between elements corresponds to the thickness of inner walls of the tray. The turning unit is provided with a movable platform mounted in lower part of the turning unit, below the inlet conveyor and movable over a plane perpendicular to the plane of the inlet conveyor. Said linear transporter is composed of a guide, situated along the transporter, on which there are disposed, in one plane, two separate gripping units, whereas each gripping unit has a form of a carriage, suspended on the guide, provided with two grippers, driven respectively with a belt and making reciprocating movements, whereas the carriage with grippers of the gripping unit for full trays is disposed in the zone of the end of the inlet conveyor, and the carriage with grippers of the gripping unit for empty trays is disposed in the zone of the origin of the outlet conveyor. During unloading of a full tray the gripping unit moves stepwise, each time by the distance equal to the width of the compartment, and an unloading conveyor also moves stepwise in synchronism with the full tray carried in the gripping unit, each time by the distance equal to the width of the compartment. Walls of the throat, perpendicular to rod shaped elements, are movable and constitute an alignment device for elements, whereas the width of the throat corresponds to the width of compartments of the tray. Below the throat there is disposed a movable support of top surface dimensions corresponding to the dimensions of the inlet of the throat, whereas during continuous operating of the device the top surface of the support is situated in the plane of an out-feeding conveyor. A significant technical problem, when unloading the trays, is that the rod shaped elements remain on the bottom and the walls of the tray when it is turned upside down, as a result of the action of the electrostatic field. Said field occurs as a result of accumulation of the electric charge on the tray made of dielectric material as well as on dielectric rod shaped elements when the trays are being filled with the elements, when the elements rub against the walls and the bottom of the tray, whereas the friction intensifies the development of this phenomenon. In consequence of rubbing, the elements and the tray electrify with opposite charges, which results in the occurrence of differently directed electrostatic field in the tray and the rod shaped elements. A great attractive force of such field causes clinging of the elements to the walls of the tray, which renders impossible its complete emptying on the unloading device, for example on the said MFM TU unloading device. The above mentioned phenomenon intensifies on account of the fact that the rod shaped elements electrify already during their manufacturing and conveying, as well as due to earlier accumulation of electric charge in empty trays during handling; said charge is not removed during the filling operation and, as a result, on one tray may exist locally, independently of each other, multiple electrostatic fields. Different solutions of this long-known problem were attempted, also in other fields of technology. For example, from the description of the European patent no. EP 2.119.512, the method and device for removal of electrified small particles from glass tube containers during their production are known. During cutting of said containers to specified length, inside them may get glass particles, whereas during treatment the particles and the tubes electrify with opposite charges. The described method consists in preliminary neutralization of charges of the molecules and the container by feeding appropriately ionized air into the tube, and then blowing out molecules without charge with the aid of compressed air. The method and the device provide for the possibility of using two separate nozzles for each operation or one common nozzle, where the ionized gas is simultaneously the gas washing out neutralized particles. On the other hand, in the description of the U.S. Pat. No. 4,893,759 the device for removing electrostatic charge from shredded pieces of paper occurring as a result of shredding of paper in the shredder and throwing it in the container was presented. Treated pieces pass through a frame which contains small rods made of conducting material and removes the electrostatic charge.

The object of the invention is to eliminate the situations when the rod shaped elements remain inside the tray during its emptying caused by the action of the electrostatic field.

According to the invention, the method of removing electrostatic charges from trays used for the transport of rod shaped elements in the production line of the tobacco industry using ionized pressurized air blown into the tray filled with said elements consists in feeding ionized air into an already turned over tray along the bottom, before its unloading, and then during unloading along side walls. In case of the compartment tray, ionized air is fed independently into the compartment being unloaded, along each inner wall of the compartment disposed above the throat through which the rod shaped elements are unloaded. The described method makes it possible to eliminate the phenomenon of rod shaped elements remaining attached on the bottom and on side walls or inner walls of the tray being unloaded, held by the forces of the electrostatic field.

The construction of a tray for temporary storage and transport of rod shaped elements in the production line of the tobacco industry, made of dielectric material, of the shape of approximately cuboid case without the front wall and the top wall, for the purpose of protection against negative action of the electrostatic field, according to the invention is provided with an insert of conducting material disposed inside the tray, whereas the insert may have the form of a layer of conducting material applied on the side walls and the bottom of the tray. Said insert may have the form of a U-shaped element covering the bottom and the side walls, whereas the side walls may be covered on outer edges and inner edges only. Moreover, the U-shaped insert may cover the bottom and only the fragments of side walls near the bottom, whereas the insert covering the bottom may be multipart. In case of compartment trays provided with multiple vertical inner walls parallel to side walls, which divide the interior of the tray into compartments, each compartment may have a layer of conducting material applied on inner walls or the side wall and the bottom. Each compartment may have an U-shaped insert covering the bottom and the inner walls or the side wall, whereas the insert may cover the bottom as well as the outer edges and inner edges of the inner walls or the side wall, or the bottom and a fragment of the inner walls or the side wall near the bottom, whereas the U-shaped insert covering the bottom of each compartment may be two-part. Thanks to covering the interior of the tray with conducting material, the cause of occurrence of electrostatic charges with opposite poles in the tray and the rod shaped elements, which occur during movement and rubbing of elements against the walls of the tray made of dielectric material, was eliminated to a great extent.

The essence of the device for unloading compartment trays made of dielectric material, filled with rod shaped elements, having an inlet conveyor for full trays and an outlet conveyor for empty trays arranged parallel in one plane, and having a turning unit for trays as well as a linear transporter for trays situated in a plane perpendicular to the plane of said conveyors, provided with the first gripping unit for the tray, arranged movably, and the second gripping unit for the tray, and below the linear transporter, in the zone of operating of the first gripping unit is situated the unloading conveyor the end of which is situated at the inlet of an immovable throat, constitutes the use of a horizontal ionizer installed along the linear transporter for trays, in the zone of feeding trays by the turning unit and in the zone of operating of the first gripping unit as well as two vertical ionizers installed above an immovable throat, within a distance of each other corresponding to the width of a compartment of the tray, whereas the nozzles of the horizontal ionizer are turned in the direction of the interior of the bottom of fed full tray, and the nozzles of the horizontal ionizers are turned in the direction of the corresponding wall of the compartment being unloaded. The ionizers may be disposed in one vertical plane, whereas the vertical ionizers are situated within a small distance of the outer edges of a compartment of the tray, and the horizontal ionizer is situated within a small distance of the outer edge of the bottom of the tray. The ionizers may have the shape of a longitudinal beam with a centrally disposed duct supplied with compressed air delivered to a row of nozzles arranged evenly along the beam axis, whereas on both sides of the nozzles are situated ionizing brushes connected to a voltage source. Furthermore, in the trays made of dielectric material, unloaded in the device, each compartment may have an inner insert of conducting material. The use of air ionizers generating positively and negatively charged molecules blowing the air ionized that way in the region of the bottom of the tray loaded with rod shaped elements and in the region of the walls of the compartment being unloaded, respectively, causes that the electrostatic charges accumulated in the tray are neutralized, whereas said charges are small owing to the use of trays protected against the action of the electrostatic field.

Figure 2:
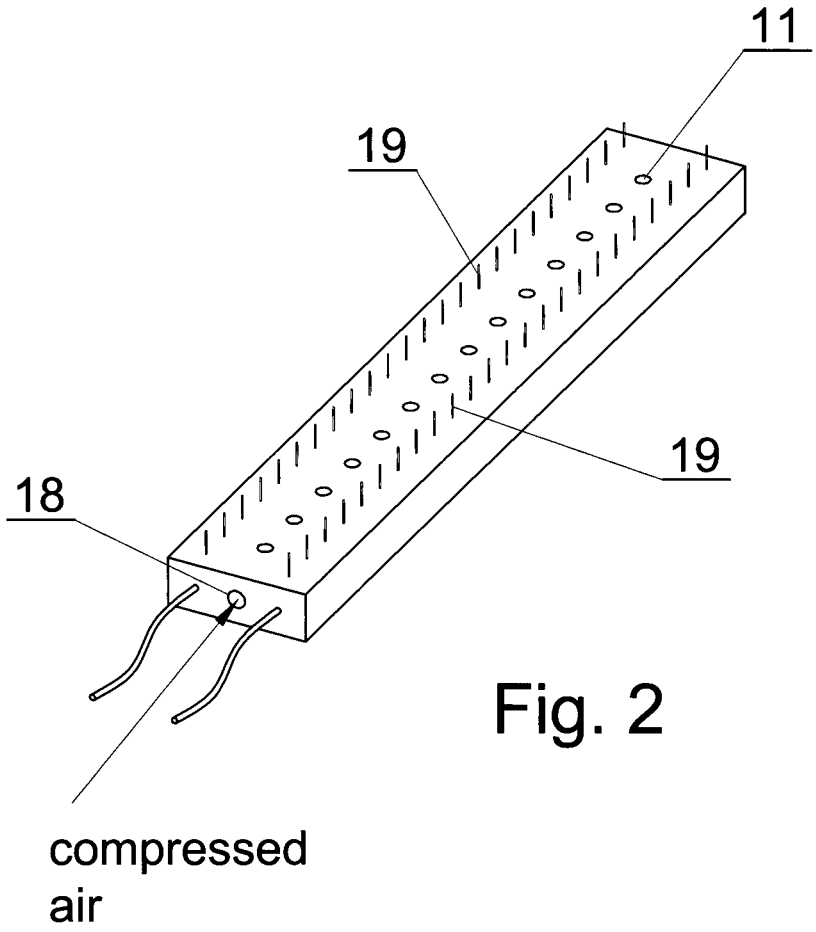
Figure 3:
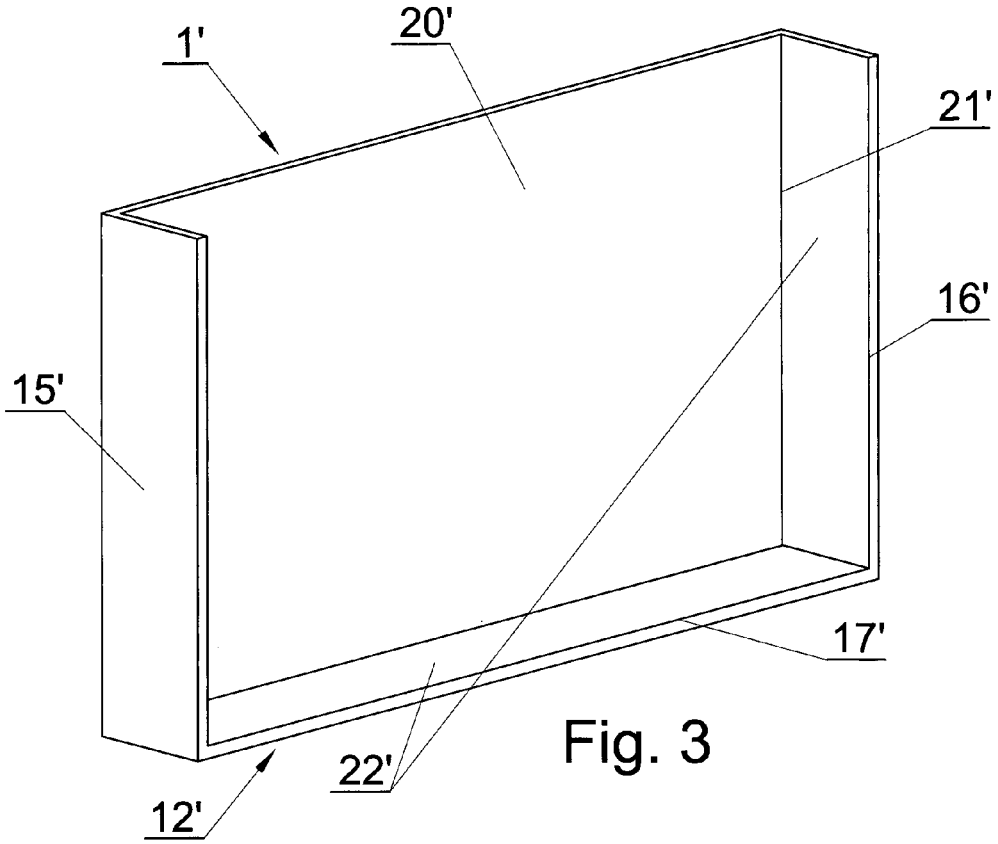
Figure 4:
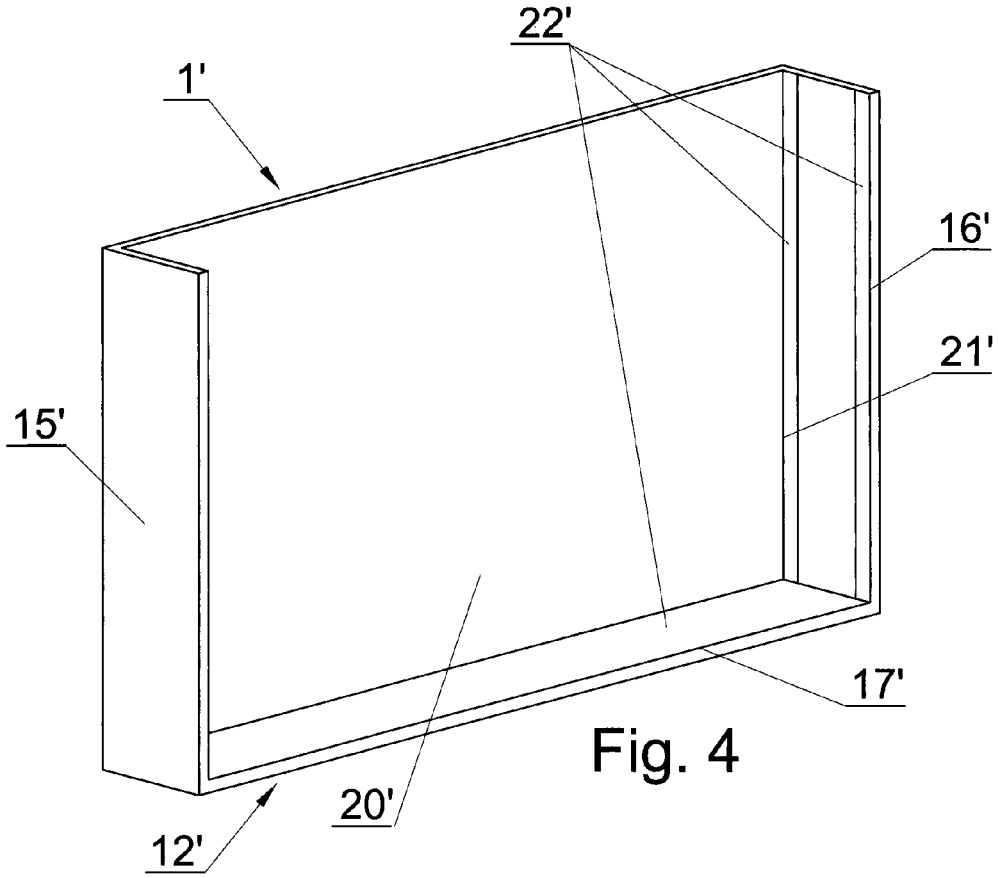
Figure 5:
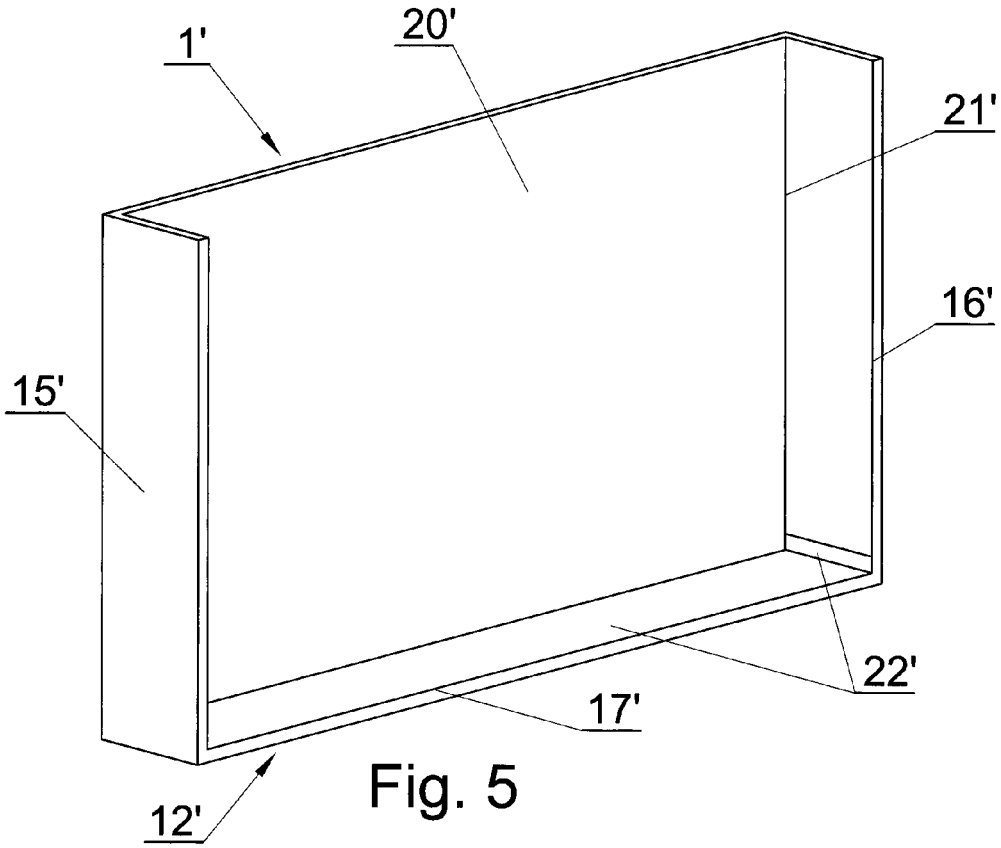
Figure 6:
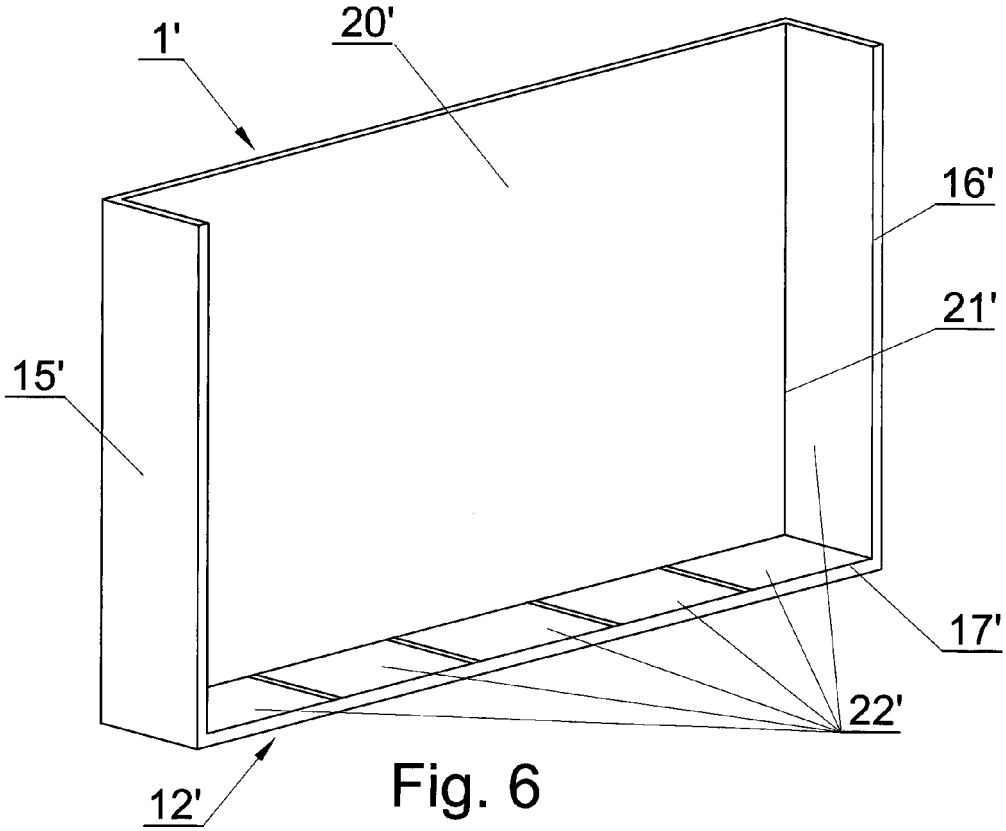
Figure 7:
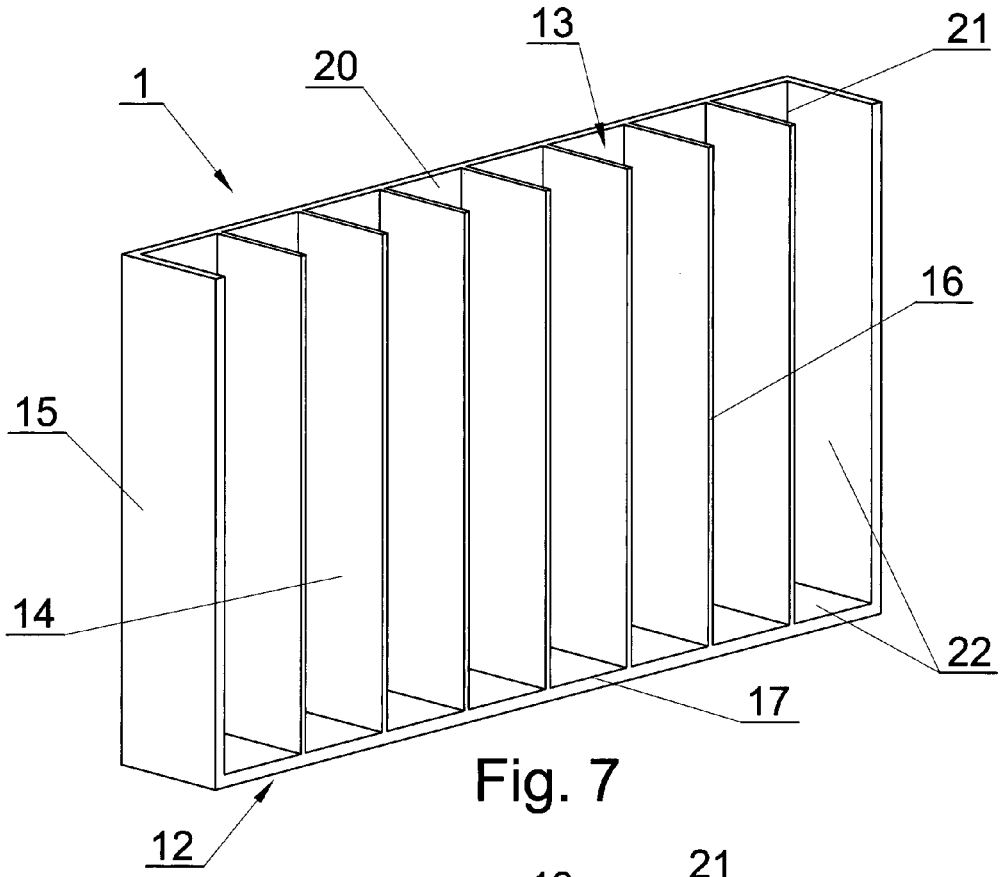
Figure 8:
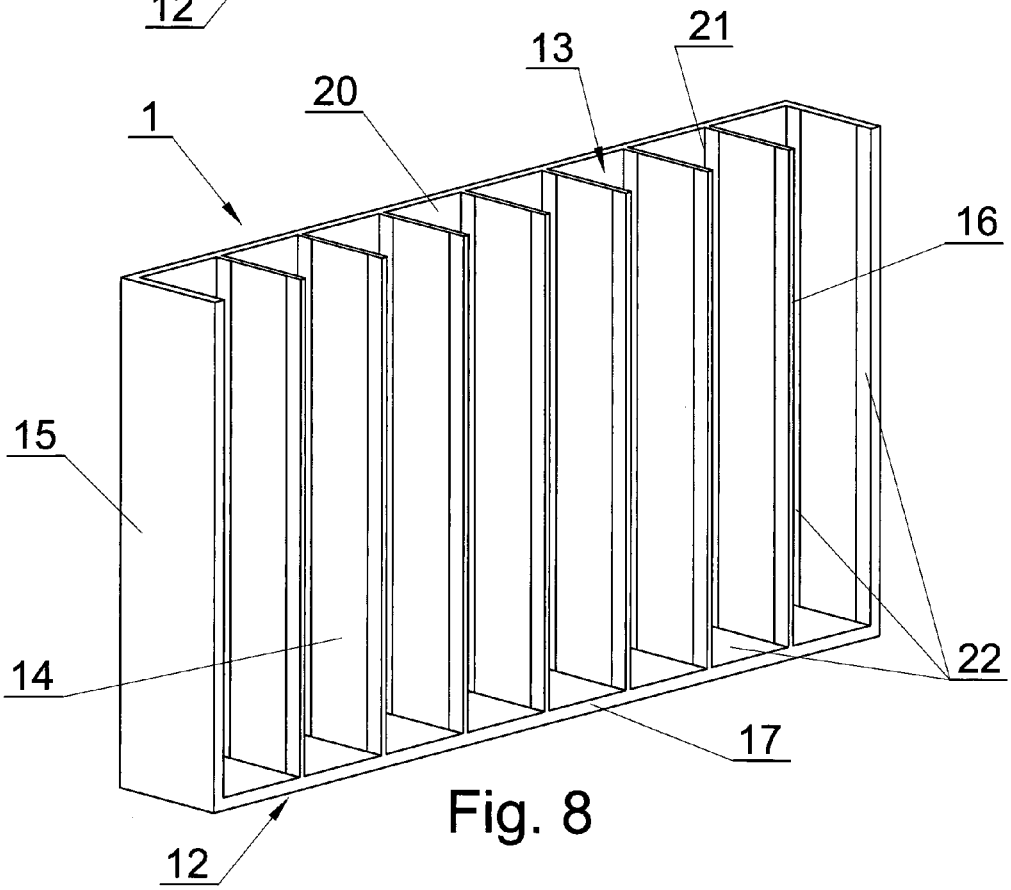
Figure 9:
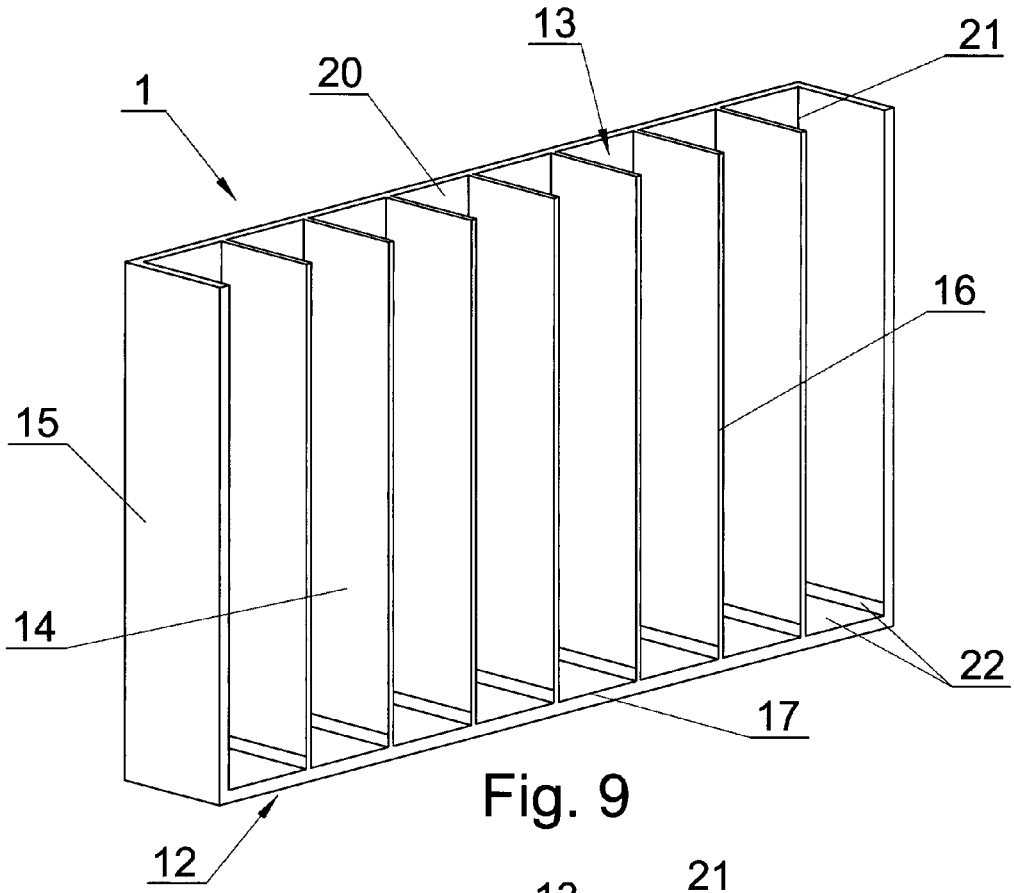
Figure 10:
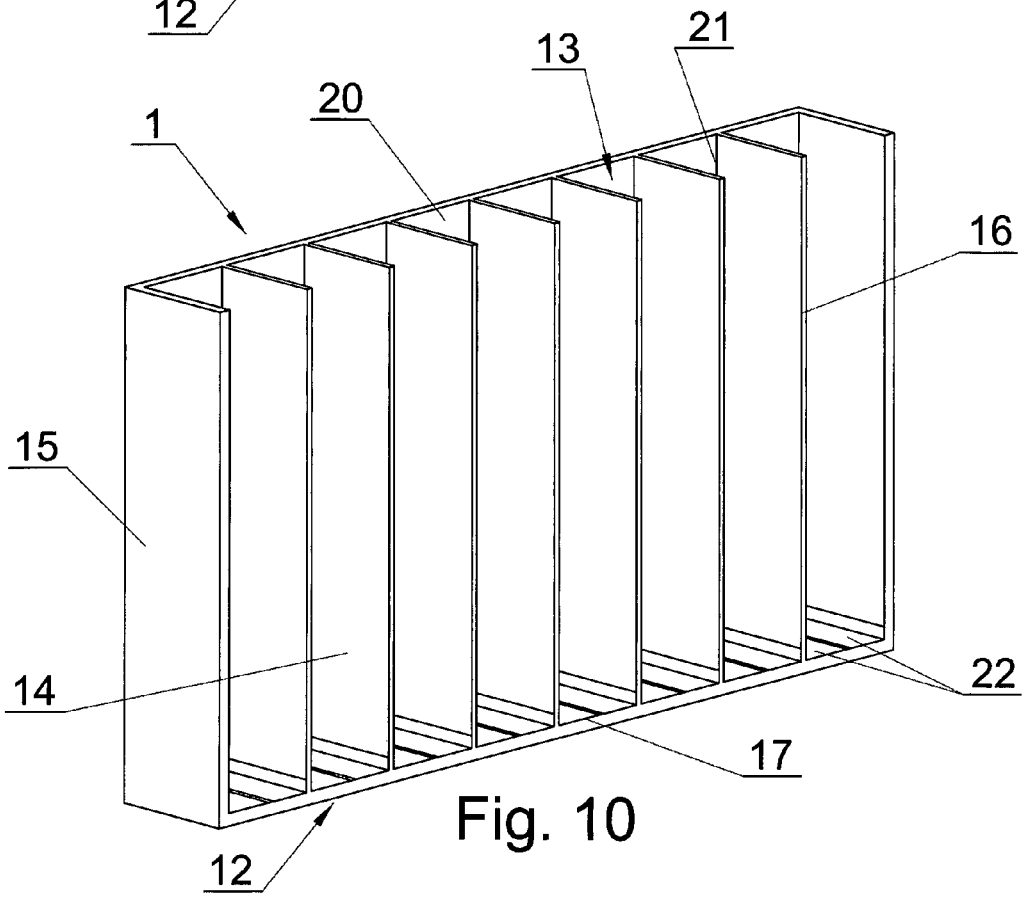

For the purpose of better understanding, the subject matter of the invention was presented in embodiments in the drawing in which FIG. 1 presents a perspective view of a device for unloading compartment trays provided with ionizers, FIG. 2—a fragment of the ionizer in a perspective view, FIG. 3—a traditional tray made of dielectric material, protected against the negative action of the electrostatic field with the aid of an insert, FIG. 4—the tray of FIG. 3 with an insert covering the bottom as well as the outer edges and the inner edges of side walls, FIG. 5—the tray of FIG. 3 with U-shaped insert covering the bottom and a fragment of side walls near the bottom, FIG. 6—the tray of FIG. 3 in which the insert covering the bottom is multipart, FIG. 7—a compartment tray made of dielectric material, provided with multiple vertical inner walls parallel to side walls, protected against negative action of the electrostatic field with the aid of inserts disposed in each compartment, FIG. 8—the tray of FIG. 7 with an insert covering the bottom as well as the inner and outer edges of the walls of each compartment, FIG. 9—the tray of FIG. 7 with U-shaped insert covering the bottom and a fragment of walls of each compartment near the bottom, and FIG. 10—the tray of FIG. 7 in which the insert covering the bottom is two-part.

The device for unloading compartment trays 1 made of dielectric material, filled with rod shaped elements, has an inlet conveyor 2 for full trays 1 and an outlet conveyor 3 for empty trays 1 situated parallel and in one plane. In the end zone of the inlet conveyor 2 is situated a turning unit 4 for full trays 1. Above the turning unit 4, in a plane perpendicular to the plane of the inlet conveyor 2 and the outlet conveyor 3 is situated a linear transporter 5 provided with a first gripping unit 6 for full trays 1 and a second gripping unit 7 for empty trays 1. Below the linear transporter 5, in the zone of operating of the first gripping unit 6, is situated an unloading conveyor 8 the end of which is situated at the inlet of an immovable throat 9. Along the linear transporter 5, in the zone of feeding full trays 1 by the turning unit 4 and operating of the first gripping unit 6, is disposed vertically an ionizer 10 so that its nozzles 11 are turned in the direction of the inside of the bottom 12 of a full tray 1 being fed. Above the immovable throat 9 are disposed vertically two ionizers 10 within a distance of each other corresponding to the width of a compartment 13 of the tray 1, whereas their nozzles 11 are turned in the direction of the corresponding inner wall 14 of the compartment 13 currently unloaded by the throat 9 or a side wall 15 of the tray 1 in case of unloading terminal compartments 13 of the tray 1. All ionizers 10 may be disposed preferably in one vertical plane, whereas vertical ionizers 10 are situated within a small distance of outer vertical edges 16 of the compartment 13, and the horizontal ionizer 10 is situated within a small distance of the outer edge 17 of the bottom 12 of the tray 1. The ionizers 10 may have the shape of a longitudinal beam with a centrally disposed duct 18 supplied with compressed air delivered to a row of nozzles 11 arranged evenly along the beam axis, and on both sides of the nozzles 1 may be situated ionizing brushes 19 connected to a voltage source. The compartment tray 1 used in the device is made of dielectric material and has the shape of a cuboid case without the front wall and the top wall. The tray 1 has the back wall 20 and the bottom 12, and its interior is divided into compartments 13 with the aid of inner walls 14, whereas in case of terminal compartments 13 one wall is the side wall 15. The inner edges 21 of the inner walls 14 or the side walls 15 of the tray 1 are situated near the back wall 20, whereas the outer edges 16 of the inner walls 14 and the side walls 15 and the outer edge 17 of the bottom 12 are situated on the open side of the tray 1. For the purpose of protection against negative action of the electrostatic field, each compartment 13 of the tray 1 has a layer of conducting material appropriately applied on the bottom 12 and the inner walls 14 or the side wall 15. Said layer may have the form of an U-shaped insert 22 made of metal, whereas the insert 22 may cover the bottom 12 as well as the outer edges 16 and the inner edges 21 of inner walls 14 and side walls 15 on the inner side of the tray 1 or may cover the bottom 12 and a fragment of the inner walls 14 and the side walls 15 near the bottom 12 of the tray 1, and the insert 22 covering the bottom 12 may be two-part. In case of traditional trays 1' made of dielectric material, having the shape of a cuboid case without the front wall and the top wall and having a bottom 12' and side walls 15' as well as a back wall 20', the inner edges 21' of side walls 15' are situated near the back wall 20', and the outer edges 16' of side walls 15' and the outer edge 17' of the bottom 12' are situated on the open side of the tray 1'. For the purpose of protection against negative action of the electrostatic field, the tray 1' has a layer of conducting material appropriately applied on the bottom 12' and the side walls 15'. Said layer may have the form of a U-shaped insert 22' made of metal, whereas the insert 22' may cover the bottom 12' as well as the outer edges 16' and the inner edges 21' of side walls 15' on the inner side of the tray 1' or may cover the bottom 12' and a fragment of the side walls 15' near the bottom 12' of the tray 1', and the insert 22' covering the bottom 12' may be multipart.

According to the invention, in the tray 1 or 1' rod shaped elements are separated from the surface made of dielectric material with the aid of a layer of current-conducting material, preferably in form of an insert 22 or 22', which eliminates to a great extent the cause of occurrence of electrostatic charges, as rubbing of the elements against the conducting material does not cause the development of a charge. Moreover, electrostatic charges accumulated in the material of the tray 1 or 1' migrate to the conducting material and spread evenly in it, owing to which the developed electrostatic field has a smaller intensity, i.e. the force acting on the rod shaped elements, and is not able to hold the elements at the bottom 12 or 12' and the walls 14 or 14' and 15 or 15' at the back in order to counteract the gravity force. In the course of unloading compartment trays 1 on the MFM TU device owned by the applicant of this invention, in addition, the ionizers 10 causing the formation of positively and negatively charged air molecules were used. Said molecules are blown under pressure first on the bottom 12 of a full tray 1 with the aid of the ionizer 10 disposed horizontally, owing to which are neutralized the charges accumulated at the bottom 12 of the tray 1, and then along the inner walls 14 or the side wall 15 of the tray 1, forming a compartment 13, in the course of unloading the compartment 13, whereas on each inner wall 14 the ionized air is blown twice, once by the right ionizer 10 and the second time by the left ionizer 10. Owing to of the action of the ionizers 10 and the appropriate structure of the tray 1, all rod shaped elements are unloaded from the compartments 13 of the tray 1 through the throat 9 to the unloading conveyor 8.

The invention claimed is:

1. A method of removing electrostatic charges from trays used for transporting rod shaped elements in a production line in the tobacco industry, comprising using pressurized ionized air blown into a tray filled with the rod shaped elements, wherein, before unloading of the rod shaped elements, supplying the pressurized ionized air along the bottom of an already turned over tray and then during unloading of the rod shaped elements supplying pressurized ionized air along the side walls of the tray.

2. The method as in claim 1, wherein the tray is a compartment tray comprising compartments with inner walls parallel to side walls of the compartment tray, comprising supplying ionized air independently into the compartment being unloaded and along each inner wall of the compartment being disposed above a throat through which the rod shaped elements are unloaded.

3. A tray for temporary storage and transport of rod shaped elements in a production line of the tobacco industry, wherein the tray is made of dielectric material, the tray has an approximately cuboid shape and the tray comprises a bottom wall and side walls and does not contain a front wall and a top wall, wherein the tray comprises an insert which is a layer of conducting material applied inside the tray, and wherein protection against the negative action of an electrostatic field is obtained.

4. The tray as in claim 3, wherein the insert is a layer of conducting material applied on the side walls and the bottom wall of the tray.

5. The tray as in claim 3, wherein the layer of conducting material covers the bottom wall and the side walls of the tray to form a U-shaped insert.

6. The tray as in claim 3, wherein the insert covers the bottom wall as well as outer edges and inner edges of the side walls.

7. The tray as in claim 3, wherein the U-shaped insert covers the bottom wall and a fragment of the side walls near the bottom wall.

8. The tray as in claim 5, wherein the insert covering the bottom wall is a multipart insert.

9. The tray as in claim 7, wherein the U-shaped insert covering the bottom wall is a multipart insert.

10. The tray as in claim 3, comprising multiple vertical inner walls parallel to the side walls, dividing the interior of the tray into compartments, wherein the inner walls or a side wall and the bottom wall of each compartment have a layer of conducting material.

11. The tray as in claim 3, comprising multiple vertical inner walls parallel to a side wall, dividing the interior of the tray into compartments, wherein each compartment has a U-shaped insert (22) covering the bottom wall and the inner walls or the side wall.

12. The tray as in claim 3, comprising with multiple vertical inner walls parallel to the side walls, dividing the interior of the tray into compartments, wherein the insert covers the bottom wall of each compartment as well as outer edges and inner edges of the inner walls or the side wall.

13. The tray as in claim 3, comprising multiple vertical inner walls parallel to the side walls, dividing the interior of the tray into compartments, wherein a U-shaped insert covers the bottom wall of each compartment and a fragment of the inner walls or the side wall near the bottom wall.

14. The tray as in claim 11, wherein the U-shaped insert covering the bottom wall of each compartment has two parts.

15. The tray as in claim 13, wherein the U-shaped insert covering the bottom wall of each compartment has two parts.

16. A device for unloading compartment trays made of dielectric material, filled with rod shaped elements, having an inlet conveyor for full trays and an outlet conveyor for empty trays situated parallel in one plane as well as a turning unit for trays and a linear transporter for trays situated in a plane perpendicular to the plane of said conveyors, provided with a first gripping unit for the tray, situated movably, and a second gripping unit for the tray, and below the linear transporter in a zone of operating of the first gripping unit is situated an unloading conveyor the end of which is situated at an inlet of an immovable throat, wherein along the linear transporter (5) for trays (1), in a zone of feeding of the trays (1) by the turning unit (4) and operating of the first gripping unit (6), is disposed horizontally an ionizer (10) so that its nozzles (11) are turned in the direction of an inside of the bottom of the feed tray (1) filled with rod shaped elements, whereas above the immovable throat (9) are disposed vertically two ionizers (10), within a distance of each other corresponding to the width of a compartment (13) of the tray (1), the nozzles (11) of which are turned in the direction of a respective inner wall or a side wall of the compartment currently unloaded by the throat.

17. The device as in claim 16, wherein all ionizers are disposed in one vertical plane, whereas the vertical ionizers are situated within a small distance of outer edges of the compartment, and a horizontal ionizer is situated within a small distance of the outer edge of the bottom of the tray.

18. The device as in claim 16, wherein the ionizers have the shape of a longitudinal beam with a centrally disposed duct supplied with compressed air delivered to a row of nozzles arranged evenly along a beam axis, whereas on both sides of the nozzles are situated ionizing brushes connected to a voltage source.

19. The device as in claim 17, wherein the ionizers have the shape of a longitudinal beam with a centrally disposed duct supplied with compressed air delivered to a row of nozzles arranged evenly along a beam axis, whereas on both sides of the nozzles are situated ionizing brushes connected to a voltage source.

20. The device as in claim 16, wherein each compartment of the tray being unloaded is provided inside with an insert of conducting material.

* * * * *